US009957094B2

(12) United States Patent
Maas

(10) Patent No.: US 9,957,094 B2
(45) Date of Patent: May 1, 2018

(54) HAIR ACCESSORY HOLDER

(71) Applicant: Balanced Act LLC, Cranford, NJ (US)

(72) Inventor: Anne Maas, Cranford, NJ (US)

(73) Assignee: Balanced Act LLC, Cranford, NJ (US)

( * ) Notice: Subject to any disclaimer, the term of this patent is extended or adjusted under 35 U.S.C. 154(b) by 0 days. days.

(21) Appl. No.: 15/227,156

(22) Filed: Aug. 3, 2016

(65) Prior Publication Data

US 2018/0037385 A1 Feb. 8, 2018

(51) Int. Cl.

| | |
|---|---|
| ***A47F 5/08*** | (2006.01) |
| ***A47F 1/04*** | (2006.01) |
| ***A47F 7/00*** | (2006.01) |
| ***B65D 73/00*** | (2006.01) |
| ***A45D 44/00*** | (2006.01) |
| ***B65D 75/56*** | (2006.01) |
| ***A47G 25/00*** | (2006.01) |
| *A47F 5/00* | (2006.01) |

(52) U.S. Cl.

CPC ..... *B65D 73/0014* (2013.01); *A45D 44/00* (2013.01); *A47F 5/0884* (2013.01); *A47G 25/005* (2013.01); *B65D 75/563* (2013.01); *A47F 2005/0012* (2013.01)

(58) Field of Classification Search

CPC ..... A45D 2008/002; A45D 8/34; A45D 8/36; A45D 44/00; B65D 73/0014; B65D 75/563; B65D 5/4208; A47F 2005/0012; A47F 5/0006; A47F 5/0884; A47F 7/10; A47G 25/005; A41G 5/00

USPC ..... 211/113, 60.1, 85.2, 85.3; 206/581, 806, 206/232; 132/248, 128

See application file for complete search history.

(56) References Cited

U.S. PATENT DOCUMENTS 1,201,979 A * 10/1916 Noyes ..... B65D 73/0014 206/478
1,273,377 A * 7/1918 Josephen ..... B65D 73/0014 206/478
1,842,072 A * 1/1932 Collingbourne ... B65D 73/0014 206/478
1,974,156 A * 9/1934 Hockmeyer ..... A45C 3/12 206/278
1,991,306 A * 2/1935 Woolsey ..... A47F 7/0021
2,375,087 A * 5/1945 De Bruin ..... A63G 9/00 206/478
2,868,371 A * 1/1959 Thorpe ..... A47F 5/0006 206/278
3,635,353 A * 1/1972 Matsubara ..... B65D 73/0042 211/34
3,970,129 A * 7/1976 Tepfer ..... A45C 11/18 150/149
4,768,649 A * 9/1988 Kolton ..... A47G 25/743 206/278
4,967,913 A * 11/1990 Bayer ..... A47F 5/0006 211/118

(Continued)

*Primary Examiner* — Jennifer E. Novosad
(74) *Attorney, Agent, or Firm* — Peter A. Nieves; Sheehan Phinney Bass & Green PA

(57) ABSTRACT

A hair accessory holder including a body member, one or more straps extending along the body member for attachment of barrettes, bobby pins, clips and the like, and one or more portions of the body member configured for attachment of hair elastics, bands and the like. The hair accessory holder provides a compact, lightweight mechanism for holding a variety of hair accessories for organization, travel, and display.

20 Claims, 9 Drawing Sheets

(56) References Cited

U.S. PATENT DOCUMENTS

D341,044 S * 11/1993 Fulgenzi ..... D6/513
5,282,553 A * 2/1994 Ibled ..... A47G 25/005 206/292
5,613,614 A * 3/1997 Richardson ..... A47F 5/08
D385,701 S * 11/1997 Bagaria ..... D3/301
5,950,844 A * 9/1999 Taylor ..... A47B 43/00 211/118
6,076,685 A * 6/2000 Ramirez ..... A47F 5/0006 211/113
6,126,021 A * 10/2000 Wilhite ..... A47B 43/04 211/113
6,471,053 B1 * 10/2002 Feibelman ..... A47F 7/02 206/495
6,547,065 B2 * 4/2003 Lackman ..... B65D 85/18 206/278
7,131,545 B1 * 11/2006 Grogan ..... A47G 23/0208 211/113
7,963,005 B2 * 6/2011 Knox ..... A41D 27/08 206/478
8,651,344 B2 * 2/2014 Norman ..... A47G 25/005 223/87
8,714,370 B2 * 5/2014 Jebara ..... A45F 5/06 211/34
8,783,475 B2 * 7/2014 Carver ..... A47G 25/08 211/113
8,939,286 B2 * 1/2015 Hesse ..... B44D 3/125 206/361
8,994,535 B2 * 3/2015 Coote ..... A47G 25/005 223/85
9,022,235 B2 * 5/2015 Kalinsky ..... A47G 25/005 211/113
9,314,074 B2 * 4/2016 Johnson ..... A45C 1/06
2003/0159962 A1 * 8/2003 Heo ..... B65D 73/0071 206/461
2004/0050751 A1 * 3/2004 Hood ..... B65D 73/0021 206/581
2004/0222125 A1 * 11/2004 Meing ..... A45C 11/26 206/581
2005/0194334 A1 * 9/2005 Johnson ..... A45D 8/36 211/85.2
2008/0216293 A1 * 9/2008 Wong ..... B65D 73/0014 24/265 R
2012/0111742 A1 * 5/2012 Choi ..... A45D 44/005 206/8
2013/0068919 A1 * 3/2013 Antonioni ..... F16M 13/00 248/614
2013/0206628 A1 * 8/2013 Batres ..... A45C 11/26 206/457
2015/0223537 A1 * 8/2015 Kim ..... A41G 5/004 206/581
2015/0351574 A1 * 12/2015 Eslami et al. ..... A47G 29/08
2015/0380141 A1 * 12/2015 Mayfield ..... A45C 11/00 361/679.01
2016/0157578 A1 * 6/2016 Ricci ..... A45D 8/34 132/200
2016/0206030 A1 * 7/2016 Sky Yi ..... B65D 29/00

* cited by examiner

HAIR ACCESSORY HOLDER

FIELD OF THE INVENTION

The present invention relates to an apparatus for storing, organizing and transporting hair accessories such as, but not limited to, barrettes, bows, clips, bobby pins, and elastic bands.

BACKGROUND OF THE INVENTION

The point of sale packaging for hair accessories is commonly a 2-sided card made from paper with diecuts to accommodate the accessories. After purchasing such hair accessories, individuals frequently store them on the original packaging. Over time, however, the paper generally deteriorates as a result of continued handling. Hair accessories are then lacking storage. As a result, they become difficult to organize and are often misplaced and/or lost. Further, individuals who have purchased multiple accessories on separate packaging often end up having many original packaging units in their possession, which contributes to disorganization and utilizes storage space in drawers, shelves, closets and other locations in which the accessories are stored.

Hair accessories can easily be misplaced and lost while traveling. Some individuals utilize travel pouches or small bags to transport their accessories. These are generally bulky and utilize valuable luggage space. Further, it becomes increasingly difficult to find a particular hair accessory when a variety of accessories are thrown together in a travel pouch or small bag.

As such, improvements for organizing, storing and transporting hair accessories are needed.

SUMMARY OF THE INVENTION

Embodiments of the present invention provide an improved apparatus for organizing and carrying hair accessories.

According to one aspect, the present invention provides a hair accessory holder comprising a body member having a top end, a bottom end, a left side, a right side, a front surface and a back surface; the body member having at least one tapered portion of reduced width along a length thereof; at least one strap extending along at least a portion of the front surface and at least a portion of the back surface; and a plurality of fasteners attaching the at least one strap to the body member.

Embodiments according to this aspect can include one or more of the following features. The at least one strap extends along the front surface from a location near the top end of the body member, to the bottom end of the body member where the strap wraps around the bottom end of the body member, and continues to extend along the back surface to a location near the tip end of the body member. At least one fastener attaches the at least one strap to the body member in the location near the top end of the body member, and at least one fastener attaches the at least one strap to the body member in the tapered portion of reduced width, thereby providing separate strap portions. One or more hair accessories attached to the at least one strap are separated from one or more hair accessories attached to the at least one tapered portion. One or more fasteners are disposed in the body member to separate the hair accessories attached to the at least one strap from hair accessories attached to the at least one tapered portion. The holder further comprises a hanging mechanism disposed at the top end of the body member. The body member is fabricated of a material selected from plastic, metal, wood, rubber, and cork. The at least one strap is fabricated of an elastic material.

According to another aspect, the present invention provides a hair accessory holder kit comprising (a) a hair accessory holder comprising a body member having a top end, a bottom end, a left side, a right side, a front surface and a back surface; the body member having at least one tapered portion of reduced width along a length thereof; at least one strap extending along at least a portion of the front surface and at least a portion of the back surface; and a plurality of fasteners attaching the at least one strap to the body member; and (b) a pouch for housing the hair accessory holder.

Embodiments according to this aspect can include one or more of the following features. The at least one strap extends along the front surface from a location near the top end of the body member, to the bottom end of the body member where the strap wraps around the bottom end of the body member, and continues to extend along the back surface to a location near the tip end of the body member. At least one fastener attaches the at least one strap to the body member in the location near the top end of the body member, and at least one fastener attaches the at least one strap to the body member in the tapered portion of reduced width, thereby providing separate strap portions. One or more hair accessories attached to the at least one strap are separated from one or more hair accessories attached to the at least one tapered portion. One or more fasteners are disposed in the body member to separate the hair accessories attached to the at least one strap from hair accessories attached to the at least one tapered portion. The holder further comprises a hanging mechanism disposed at the top end of the body member. The body member is fabricated of a material selected from plastic, metal, wood, rubber, and cork. The at least one strap is fabricated of an elastic material. The pouch is fabricated of one or more materials selected from cloth, leather, suede, and rubber.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principals of the invention.

DETAILED DESCRIPTION

Figure 1A:
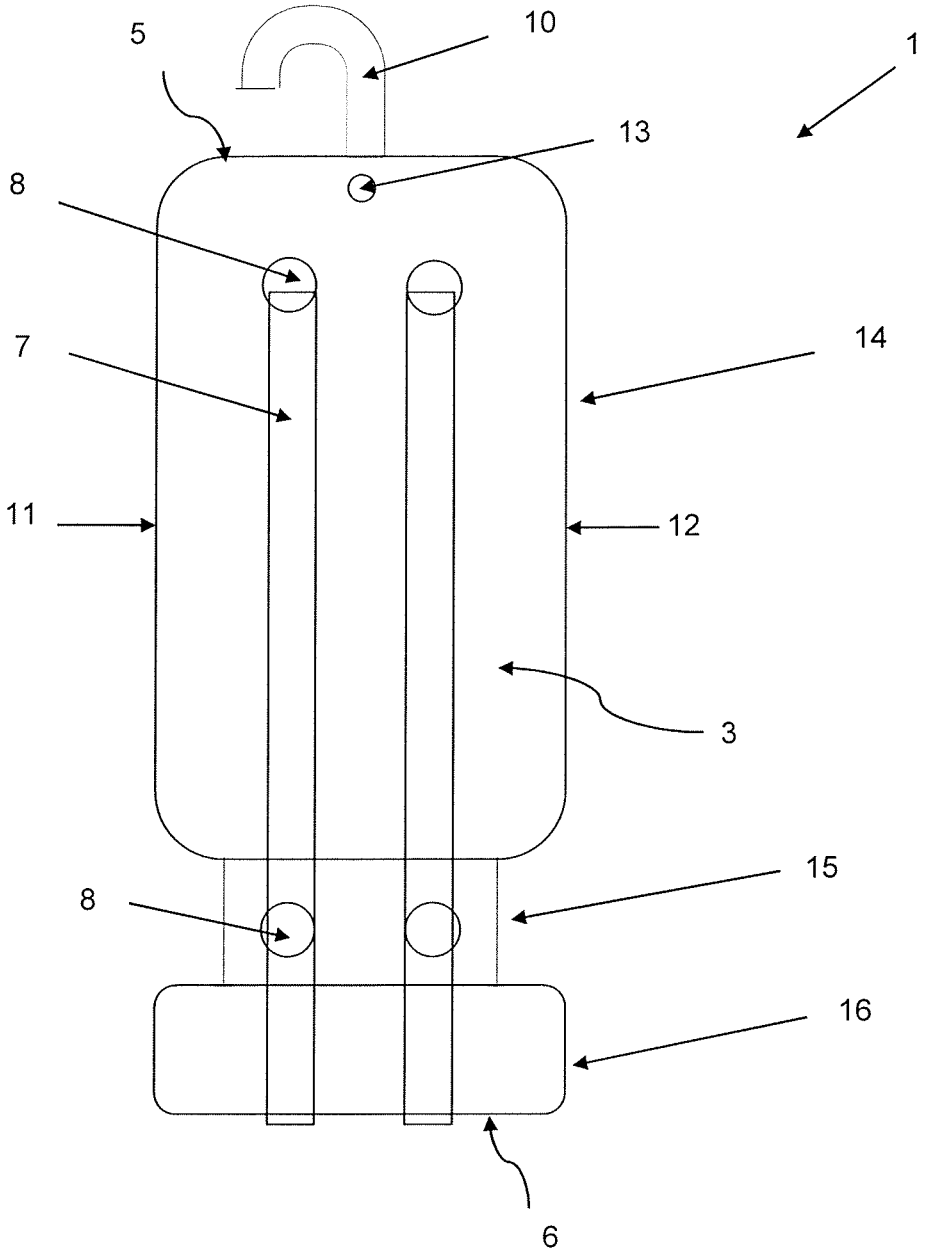
FIGS. 1A-D depict one embodiment of an accessory holder in accordance with the present invention, in which a pair of straps are provided with a three section body member.

Reference will now be made in detail to embodiments of the present invention, examples of which are illustrated in the accompanying drawings. Wherever possible, the same reference numbers are used in the drawings and the description to refer to the same or like parts.

The present invention generally provides a storage solution for hair accessories in the form of a holder to which hair accessories can be attached, clipped, wrapped around, etc. and organized. The holder accommodates many different types of hair accessories, all of which are easily secured to the holder. The holder is beneficially configured so as to provide the secured accessories in a manner in which they are fully, or at least partially, visible to a user so that the user can easily select the desired accessory. The holder is lightweight and compact, and can be conveniently transported in a variety of bags and cases such as, for example, handbags, gym bags, backpacks, briefcases and luggage. The holder provides a user with an easy way to organize a variety of hair accessories so as to reduce clutter and save space.

Figure 1B:
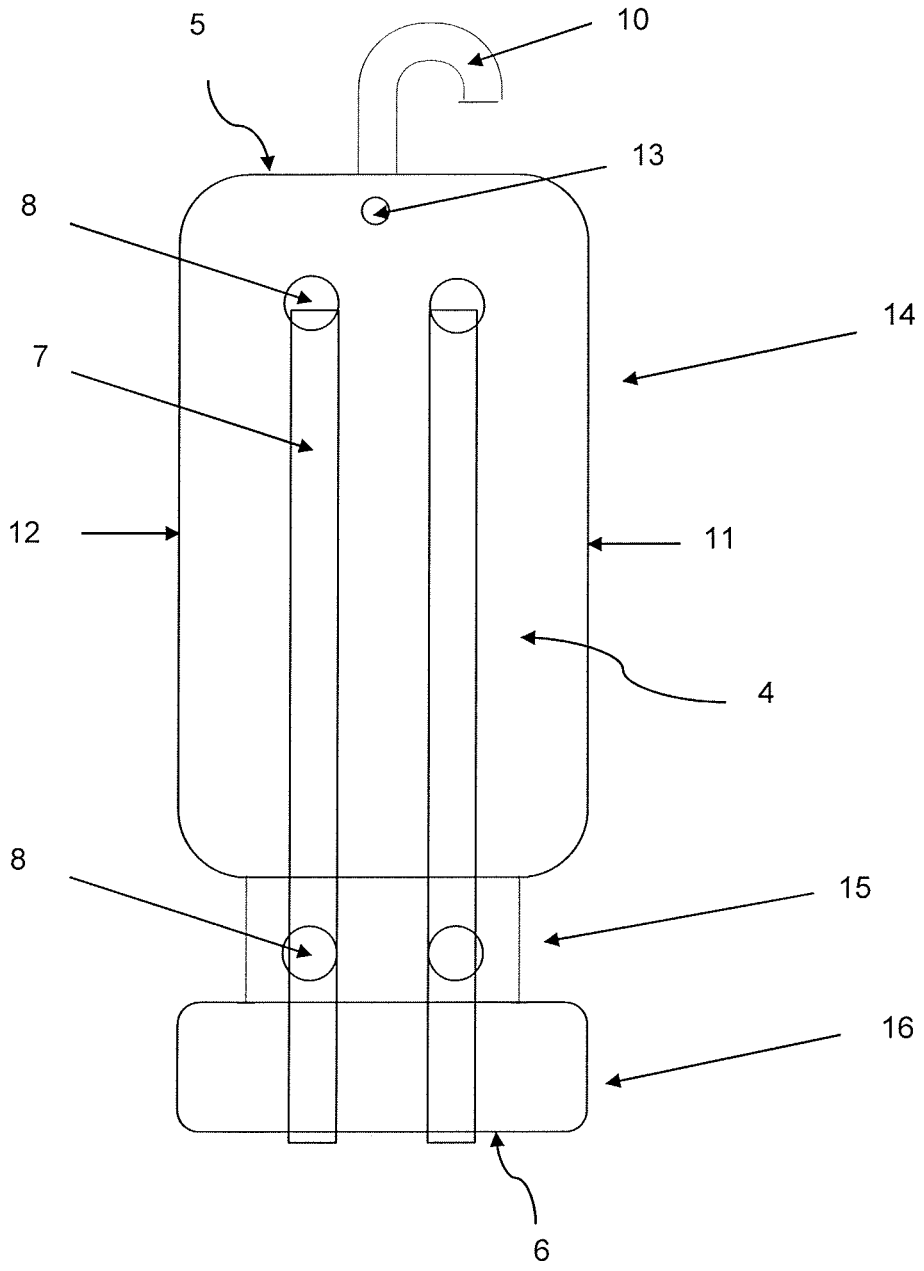
Figure 1C:
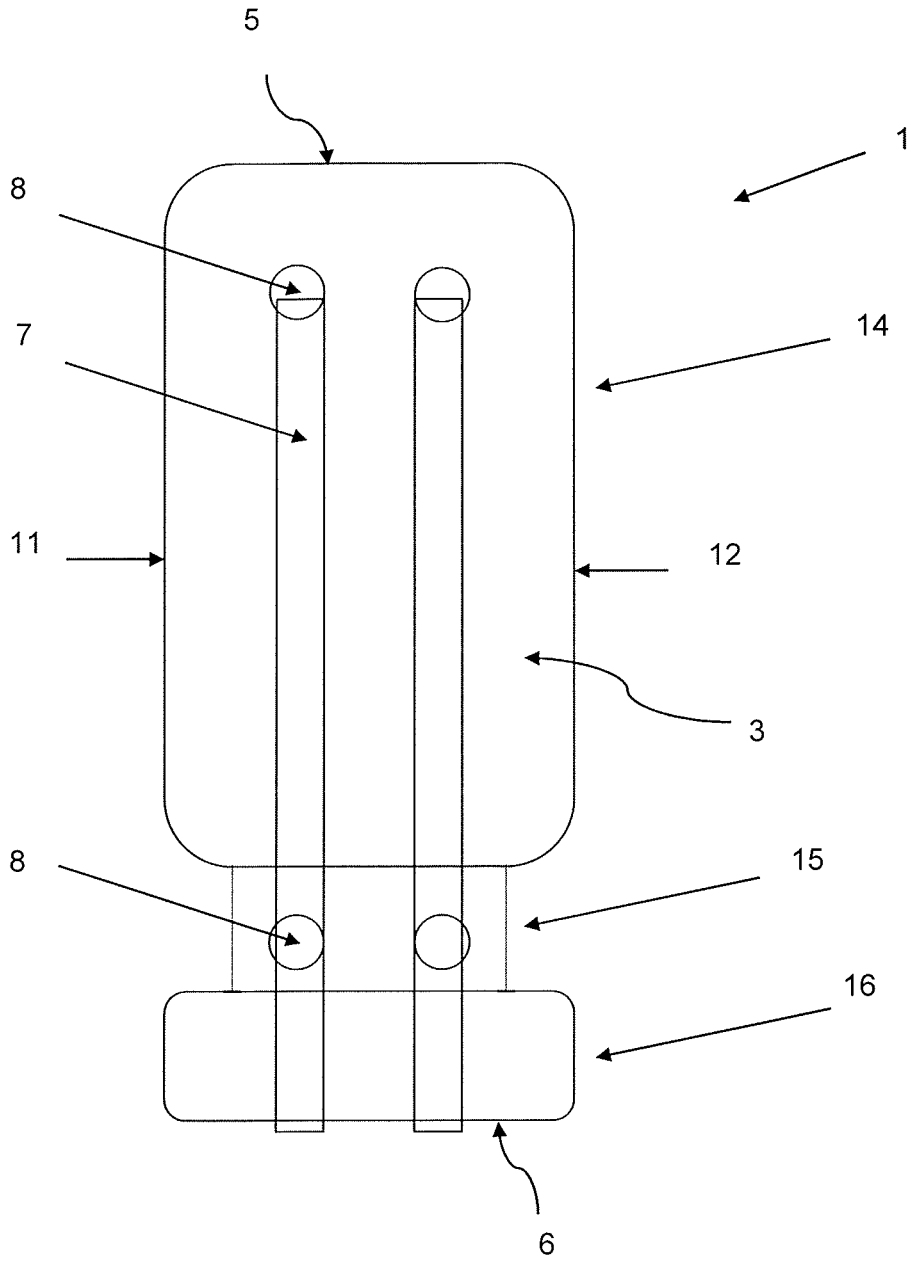

According to one embodiment of the present invention, as depicted in FIGS. 1A-C, an accessory holder 1 includes a body member 2 having a front surface 3 and a back surface 4, a top end 5 and a bottom end 6, a left side 11 and a right side 12, a pair of straps 7 extending along the front surface 3 and back surface 4, and a plurality of fasteners 8 securing the pair of straps 7 to the body member 2. As shown in this embodiment, the accessory holder 1 can further include a hanging mechanism 10 at the top end 5 that allows a user to hang the accessory holder 1 for display or storage (see FIGS. 1A-B) or it could be provided without a hanging mechanism (see FIG. 1C). The hanging mechanism 10 can be integrally formed with the body member 2, or it could be attached by an adhesive or any other suitable attachment mechanism such as, for example, a peg 13 (see FIGS. 1A-B) at a bottom portion of the hanging mechanism 10 that is pushed through and held within an opening in the body member 2.

Figure 2A:
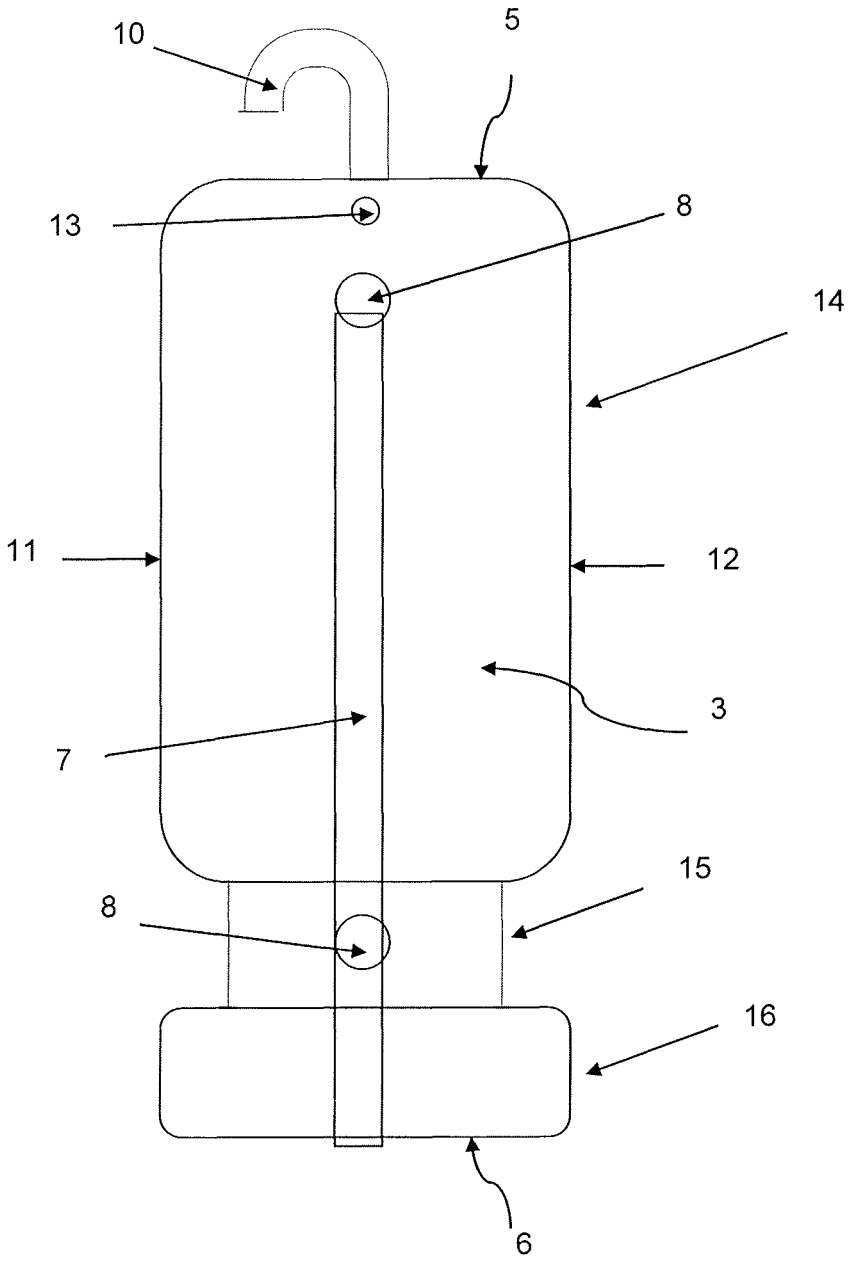
FIGS. 2A-C depict another embodiment of an accessory holder in accordance with the present invention, in which a single strap is provided with a three section body member.
Figure 2B:
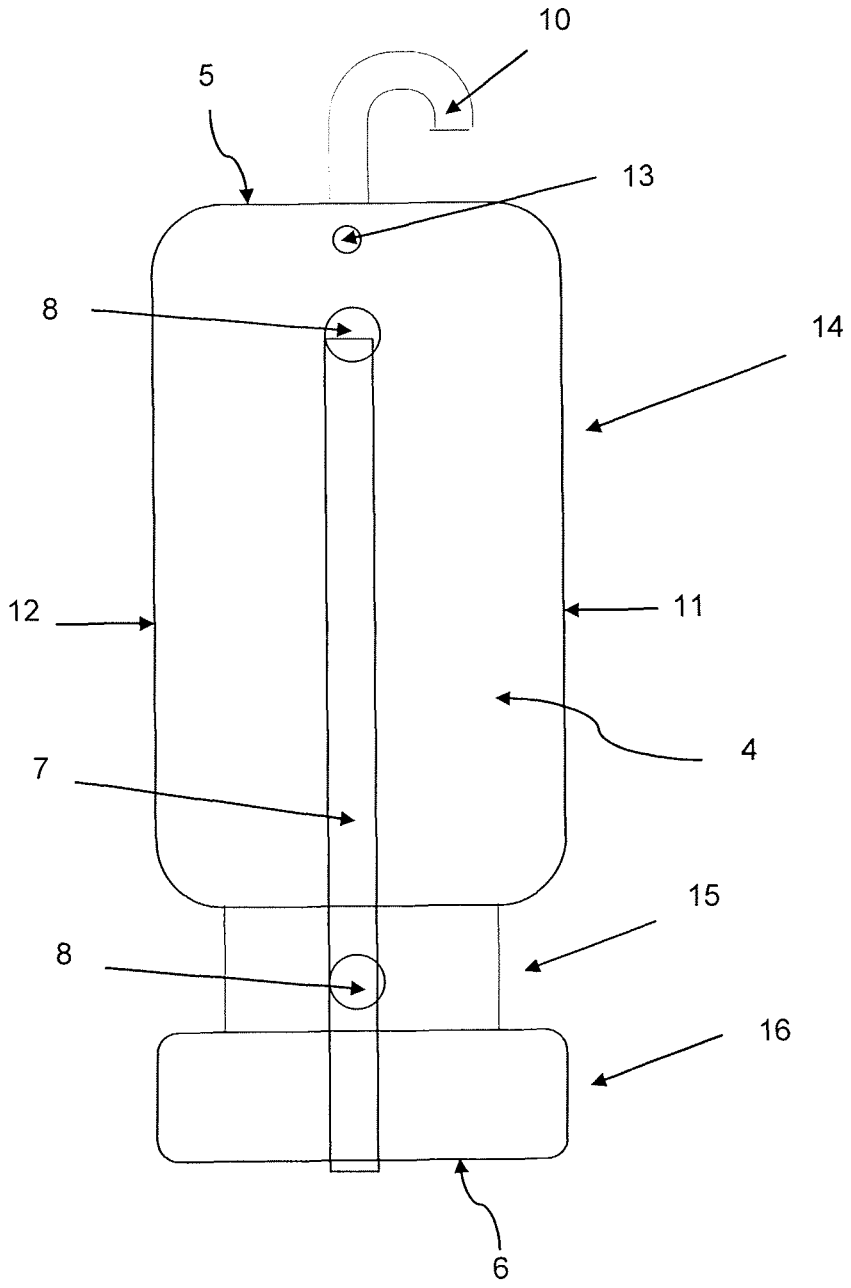
Figure 2C:
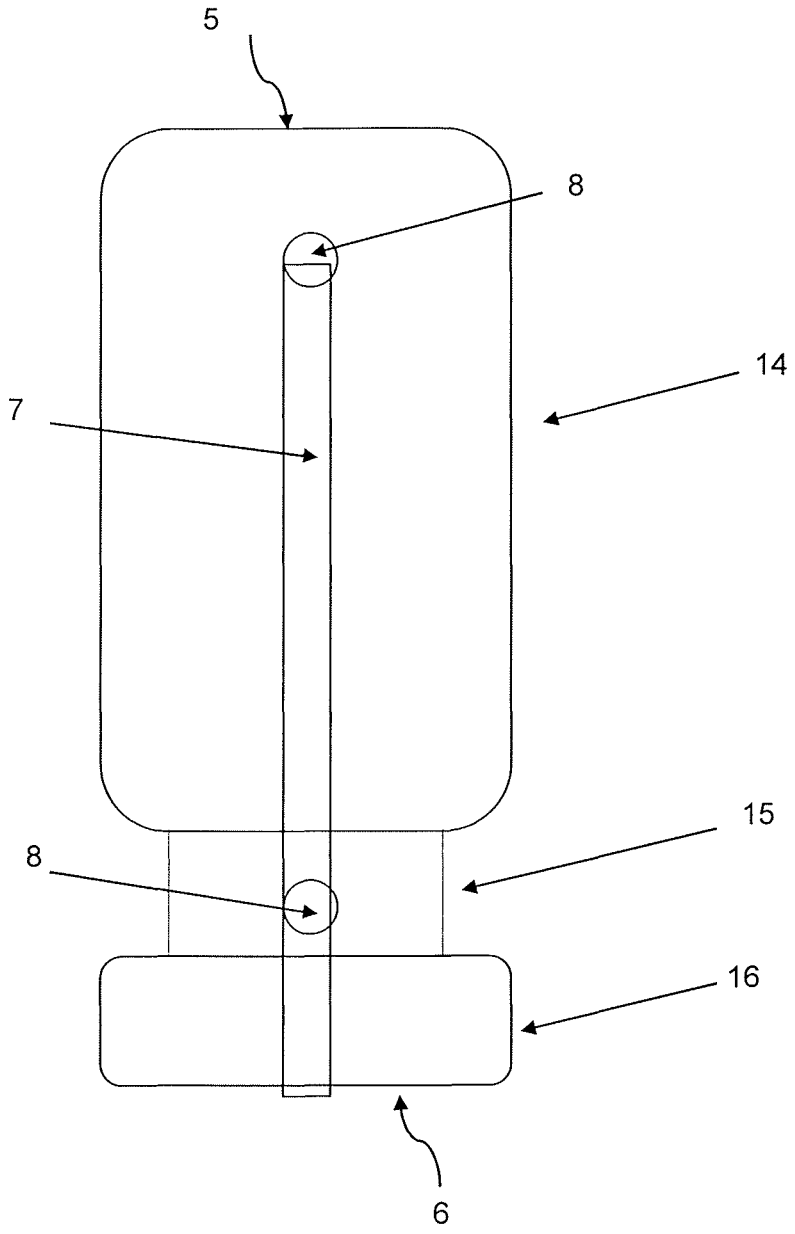

According to another embodiment of the present invention, as depicted in FIGS. 2A-C, an accessory holder 1 includes a body member 2 having a front surface 3 and a back surface 4, a top end 5 and a bottom end 6, a left side 11 and a right side 12, a single strap 7 extending along the front surface 3 and back surface 4, and a plurality of fasteners 8 securing the strap 7 to the body member 2. As with the embodiment shown in FIGS. 1A-C, the accessory holder 1 can further include a hanging mechanism 10 at the top end 5 that allows a user to hang the accessory holder 1 for display or storage (see FIGS. 2A-B) or it could be provided without a hanging mechanism (see FIG. 2C).

While the embodiments depicted by FIGS. 1A-2C, show either a pair of straps 7 or a single strap 7, the number of straps isn't particularly limited. Thus, any desired number of straps could be provided on the accessory holder 1 as long as the accessory holder 1 is suitably sized to accommodate the desired number of straps. In addition, while the straps 7 are depicted as running from a top end 5 to a bottom end 6, and in a parallel configuration when there are a plurality of straps 7, the invention is not limited as such. Thus, the straps 7 could alternatively run from the left side 11 to the right side 12 or in any angled direction relative to the body member 2. Further, if a plurality of straps 7 are provided, the straps 7 could cross each other at any desired angle rather than run parallel to each other, if desired.

As shown in the embodiments of FIG. 1A-2C the body member 2 can be provided in a plurality of sections. In particular, as best shown in FIG. 1D which shows only the body member 2, the body member 2 can be provided in three sections: a top section 14, a middle section 15, and a bottom section 16 (See FIGS. 1A-B). A multi-sectioned body member 2 could beneficially allow for attachment of bobby pins, hair clips, barrettes and the like to the straps 7 between fasteners 8 (e.g., in both the top section 14 as well as the bottom section 16). A middle section 15 could then suitably be used for attachment of hair elastics and similar accessories that could be wrapped about the middle section 15 (e.g., wrapped around parallel to the top end 5 and bottom end 6). Further, as shown in FIGS. 1A-B, the middle section 15 could be provided with a reduced width compared to a width of the upper section 14 and/or the lower section 16. Such a tapered middle section 15 can beneficially prevent hair elastics and other wrapped accessories from sliding up or down off of the middle section 15 and potentially falling off of the accessory holder 1. It is noted that a "multi-sectioned" body member 2 (e.g., sections 14, 15, 16) does not necessarily mean that there are three separate sections that are formed and then attached together to form the body member 2. While this could be the case, the multi-sectioned body member 2 could be formed as a unitary structure with multiple sections along the unitary structure. In this case, the sections would be distinguished from each other in, for example, shape, size, accessory attachment configuration, etc. For example, a long top section could be provided for holding barrettes and the like along one or more straps 7, a reduced width middle section could be provided for holding hair elastics and bands, and a wider bottom section could be provided for preventing hair elastics and bands from slipping off the accessory holder from the middle section and/or for holding barrettes and the like along one or more straps 7.

Figure 1D:
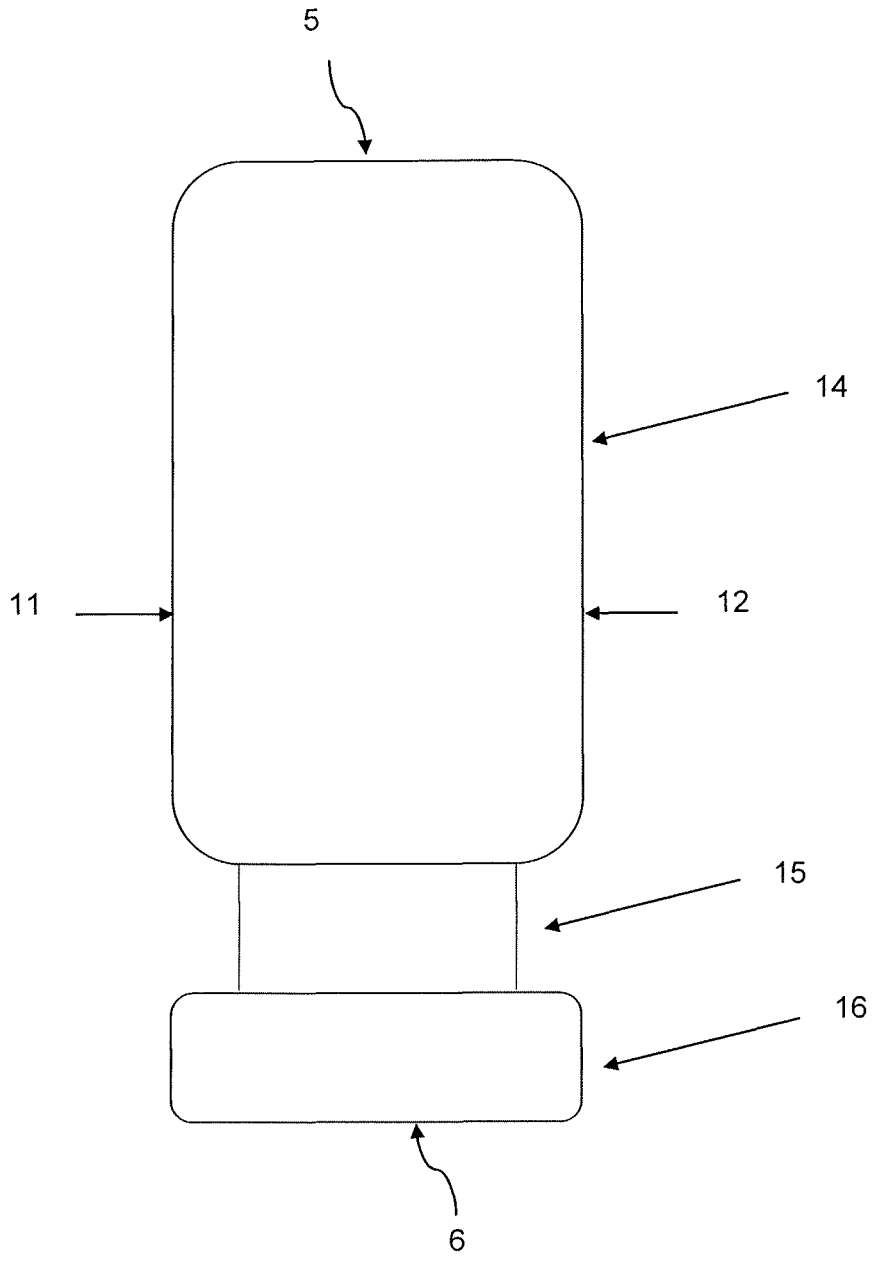

While the three sectioned body member 2 is shown as one exemplary embodiment, it is understood that the present invention could also be designed to have a body member 2 formed from a single section (e.g., as depicted in FIGS. 1C-D) or any number of sections in excess of three. In embodiments in which the number of sections is other than three, an arrangement similar to that depicted in FIGS. 1A-2C could be used to provide one or more tapered sections for attachment of hair elastics and the like, as well as one or more sections with straps 7 for attachment of bobby pins, hair clips, barrettes and the like.

As further depicted in the embodiments of FIGS. 1A-2C, the straps 7 are attached to the body member 2 with fasteners 8 at an upper portion of the top section 14 and in the middle section 15. Such a configuration can be beneficial if hair elastics or the like are held on the middle section 15 (or on one or more tapered sections if a number of sections other than three is provided) to prevent barrettes, bobby pins, clips and the like secured to the straps 7 from becoming tangled with the hair elastics and other accessories held on the middle section 15. In particular, barrettes, bobby pins, clips and the like secured on the straps 7 would be constrained from slipping and moving past the fasteners 8. Of course any other configuration for the fasteners 8 could be provided. In addition, while the straps 7 are depicted as extending along the front surface 3 and wrapping around the bottom end 6 to continue along the back surface 3, the present invention is not limited to this configuration. For example, according to alternate embodiments, the straps 7 could end and be secured near the bottom end 6 with fasteners 8.

As depicted in FIGS. 1A-2C, the overall shape of the accessory holder 1, particularly the overall shape of the body member 2, is oblong, with the hanging mechanism 10 (if included) disposed at a shorter top end 5. Such an oblong configuration could be provided through multiple sections (e.g., an upper, middle and lower section 14, 15, 16) that together form an overall oblong shape) or with a single section that has an overall oblong shape. In the embodiment depicted in FIGS. 1A-2C, the overall shape of the three-sectioned body member 2 is rectangular with rounded edges, and with a middle section 15 that tapers inward. Of course, sharp edges could also be used, if desired, as well as any other oblong shape including, for example, oval. In addition, the body member 2 could be provided with a length that is similar to its width, such as an overall square-like or circular configuration. It is noted that while the body member 2 is described as having exemplary geometric shapes, the geometric shape of the body member 2 is not particularly limited. In particular, according to some embodiments of the invention, the body member 2 itself does not hold hair accessories, but rather, one or more straps 7 and/or tapered portions within the body member 2 hold the hair accessories. As such, the shape of the body member 2 can be any shape desired.

Figure 3A:
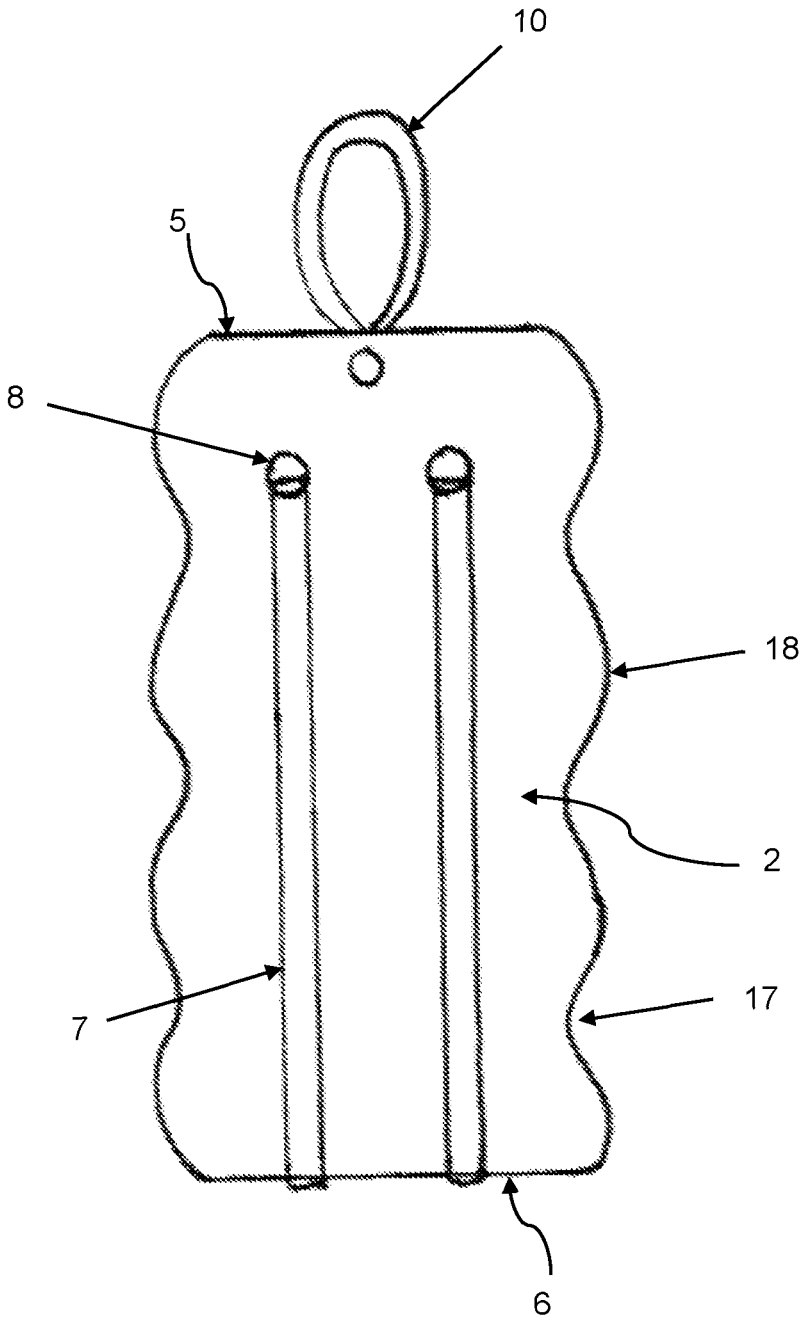
FIGS. 3A-B depict another embodiment of an accessory holder in accordance with the present invention, in which a pair of straps are provided with a single section body member.

In some embodiments, the accessory holder 1 could be provided with a generally elongate configuration with curved or irregular shaped sides 11, 12. For example, as shown in FIG. 3A, a wave-like pattern along one or more of the left and/or right sides 11, 12 could be provided, with the wave pattern including any number of concave 13 and convex portions 14. These concave 13 and convex 14 portions could, if desired, be suitable attachment areas for hair elastics, bands and the like which could be wrapped about the concave 13 areas. In another example, a pattern (either regular or irregular) could be provided in the left and/or right sides 11, 12 that includes one or more pointed or sharp angular cutout portions 17, such as that depicted in FIG. 3B. As with the wave-like pattern, the inwardly angled cutout portions 17 could, if desired, be suitable attachment areas for hair elastics, bands, and the like which could be wrapped about these areas. As with the three-sectioned body member 2 configuration, one or more straps 7 could be attached using one or more fasteners 8 positioned along the body member 2 relative to the concave 13 areas and angled areas so as to separate barrettes, bobby pins, clips and the like secured to the straps 7, and to prevent such barrettes, bobby pins, clips and the like from becoming tangled with the hair elastics, bands, and other accessories held on the concave 13 areas and angled areas.

Figure 3B:
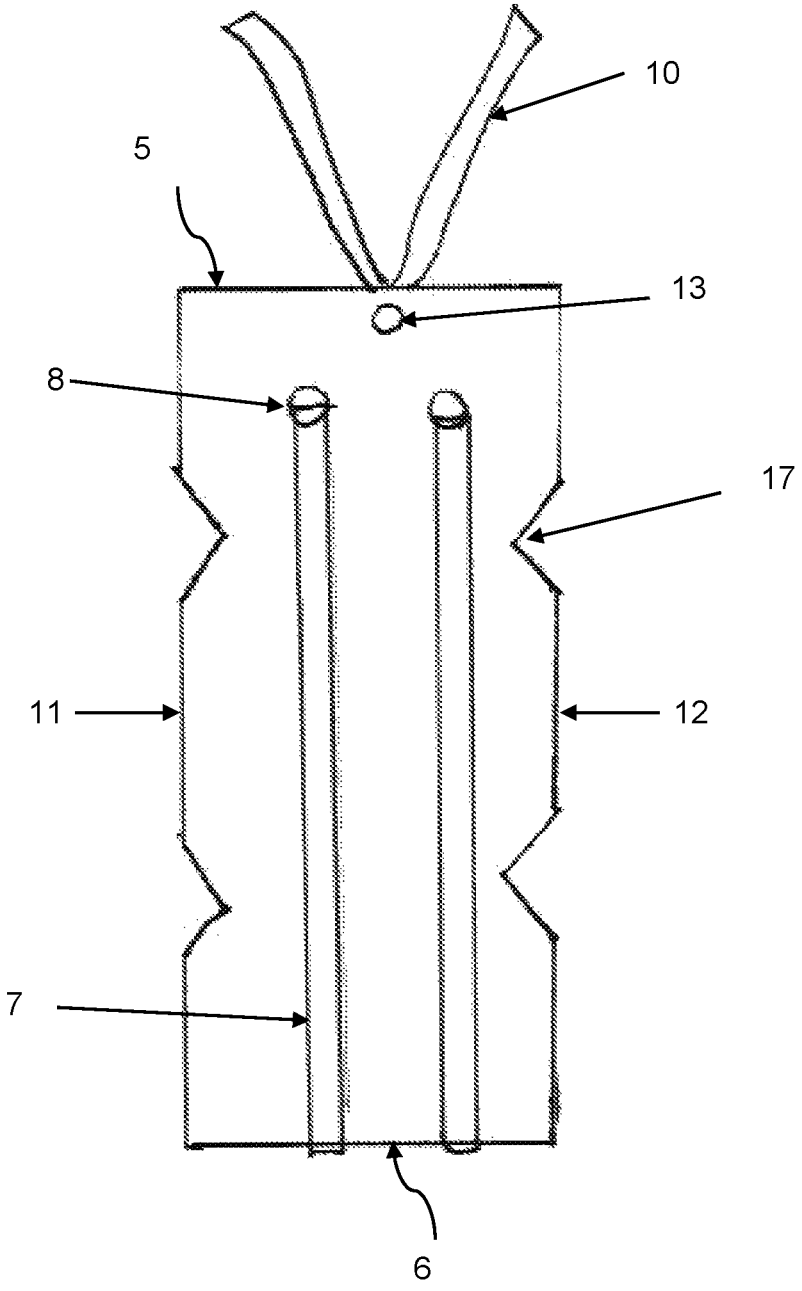

It is noted that while FIGS. 3A and 3B depict a body member 2 having a single section, one or more additional sections could be added to this configuration, if desired.

In order to provide a lightweight and strong accessory holder, the body member 2 is preferably fabricated of a plastic material. However, other materials that are generally lightweight, sturdy, thin, and pliable, and provide shape and structure could also be used. Some additional examples of materials, include, but are not limited to, rubber, cork, metals and wood.

The straps 7 can be fabricated of any material to which a bobby pin, barrette, clip or the like could be attached, and is preferably fabricated on an elastic material that allows for some stretch or flexibility in the straps 7. Such stretch or flexibility would allow for a barrette, clip, bobby pin or the like to be secured thereto with one arm or side of the barrette, clip, bobby pin or the like sandwiched between the strap 7 and the body member 2, and the strap 7 sandwiched between the two arms or sides of the barrette, clip, bobby pin or the like. For example, the straps 7 may be tightly extended along the front and back surfaces 3, 4 of the body member 2, and may be stretched or pulled slightly away from the body member 2 to allow a hair accessory to be attached thereto. In particular, the straps 7 are preferably designed so that the hair accessory is disposed on one or more of the straps 7 much like the hair accessory would be disposed on a person's hair. For example, a barrette could be attached to a strap 7 by spreading the two sides of the barrette apart, pushing one side of the barrette between the strap 7 and the body member 2, and allowing the other side of the barrette to close. Some examples of suitable materials for use in forming the straps 7 include, but are not limited to, ribbon, string, elastics, and rubber. The material is preferably any elastic and/or stretchable material that allows it to be pulled away from the body member 2 at least slightly to allow for attachment of a hair accessory.

According to an exemplary embodiment, the fasteners 8 are in the form of rivets or other fasteners which extend through the body member 2 from front surface 3 to back surface 4, and which provide fastening of a portion of a strap 7 on the front surface 3 as well fastening of a portion of a strap 7 on the back surface 4. However, any conventional fastener could be used in securing the straps 7 to the body member 2, including both adhesives as well as mechanical fasteners. In addition, it is also possible to provide holes in the body member 2 (basically in the same locations as the fasteners) such that the straps 7, which would be in the form of a loop, would simply pass through the holes to extend along the front surface 3 and the back surface 4.

In embodiments that include a hanging mechanism 10, any conventional hanging mechanism 10 could be used to allow a user to hang the accessory holder 1 from a desired structure. For example, according to some embodiments, the hanging mechanism 10 is in the form of a hook, as shown in FIGS. 1A-B and 2A-2B, which provides a user with the option of hanging the accessory holder 1 on any variety of structures that a conventional hook (e.g., a clothes hanger hook) could be hanged on including, for example, doorknobs, wall/cabinet hooks, towel bars, closet rods, pegs, nails, and similar structures. According to other embodiments, the hanging mechanism 10 is in the form of a loop (e.g., see FIG. 3A) or similar closed structure that would allow a user to hang the accessory holder 1 on a doorknob, a peg, a nail, a wall/cabinet hook, and similar structures. According to other embodiments, the hanging mechanism 10 is in the form of an open structure such as two strings (e.g., see FIG. 3B) or the like that can be secured in a knot or bow to form a closed structure that would allow a user to hang the accessory holder 1 from a doorknob, a peg, a nail, a wall/cabinet hook, a towel bar, a closet rod, and similar structures. The hanging mechanism 10 could be formed integrally with the body member 2, or it could be formed as a separate element that is attached to the body member 2 using any conventional attachment means. According to some embodiments, the hanging mechanism 10 is rotatably attached to the body member 2 to allow a user to provide the hanging mechanism 10 is an "open" position for hanging, or in a "closed" position with the hanging mechanism 10 tucked away for travel to provide a smaller profile.

The hair accessory holder 1 is not particularly limited in size. According to some preferred embodiments, the hair accessory holder 1 is about 2.5-6" wide (left to right in the figures) and about 5-14" long (top to bottom in the figures), more preferably about 3-5" wide and about 6-12" long. In embodiments including the tapered middle section 15 with a top section 14 and a bottom section 16, the allocation of tapered middle section 15 to top and bottom sections 14, 16 can vary depending on a user's preference. For example, if a user wishes to hold mostly clips, bobby pins and barrettes, and few if any hair elastics, then the tapered middle section 15 could be relatively short. According to an exemplary embodiment, a top section 14 ranges from about 3-12" long with the tapered middle and bottom 15, 16 being approximately 1" long each. According to some embodiments, the tapered middle section 15 could be larger, for example, about 1-3" long, with the bottom section 16 being about 0.5-1" long, and the top section 14 making up the balance.

According to some embodiments, the accessory holder 1 is provided together with an accessory holder pouch (not shown) that encloses the accessory holder 1. The pouch would be useful for travel by providing the accessory holder 1 and attached hair accessories in a more protected state, or if one prefers to keep their accessory holder 1 and attached hair accessories in a concealed state. The pouch could be fabricated of any material conventionally used for similar pouches (e.g, cosmetic pouches) including, but not limited to, cloth, leather, suede, rubber, etc. The pouch preferably includes a closing mechanism, such as a zipper, buttons, snaps, magnetic inserts, or an excess of fabric that folds over, to prevent the accessory holder 1 and attached hair accessories from falling out. The pouch is preferably a size that comfortably fits the accessory holder 1 and attached hair accessories without a lot of excess space, but could be formed larger if a user wishes to put a hair comb or brush in together with the accessory holder 1 for travel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A hair accessory holder comprising:

a body member having a top end, a bottom end, a left side, a right side, a front surface and a back surface;

the body member having an intermediate portion of reduced width along a length thereof between the top end and the bottom end;

at least one strap extending along at least a portion of the front surface and at least a portion of the back surface;

at least one upper fastener attaching the at least one strap to the body member adjacent the top end; and at least one lower fastener attaching the at least one strap to or below the intermediate portion of reduced width, wherein portions of the strap between the at least one upper fastener and the at least one lower fastener are not attached to the body member, and wherein the at least one strap extends along the front surface from a front side of the at least one upper fastener to a front side of the at least one lower fastener, to the bottom end of the body member where the strap wraps around the bottom end of the body member, and continues to extend along the back surface to a back side of the at least one lower fastener, and to a back side of the at least one upper fastener.

2. The hair accessory holder of claim 1, wherein the at least one lower fastener is disposed in the intermediate portion of reduced width such that one or more hair accessories attachable to the at least one strap between the at least one upper fastener and the at least one lower fastener are separated from one or more hair accessories attachable to the intermediate portion of reduced width.

3. The hair accessory holder of claim 1 further comprising one or more additional fasteners disposed in the body member to separate the hair accessories attachable to the at least one strap above the intermediate portion from hair accessories attachable to the intermediate portion of reduced width.

4. The hair accessory holder of claim 1, further comprising a hanging mechanism disposed at the top end of the body member.

5. The hair accessory holder of claim 1, wherein the body member is fabricated of a material selected from plastic, metal, wood, rubber, and cork.

6. The hair accessory holder of claim 1, wherein the at least one strap is fabricated of an elastic material.

7. The hair accessory holder of claim 1, wherein the intermediate portion separates a top portion from a bottom portion, wherein the top portion and the bottom portion each have widths greater than the reduced width of the intermediate portion, and wherein the bottom portion width is sized to prevent a hair accessory attachable to the intermediate portion from slipping downward.

8. The hair accessory holder of claim 1, further comprising one or more additional intermediate portions of reduced width disposed along a length of the body member between the top end and the bottom end.

9. The hair accessory holder of claim 8, further comprising one or more intermediate fasteners attaching the at least one strap to or adjacent to the one or more additional intermediate portions of reduced width.

10. The hair accessory holder of claim 1, comprising a single upper fastener attaching the at least one strap to the body member at a single location in the strap, and a single intermediate fastener in or adjacent to each portion of reduced width attaching the at least one strap to the body member at a single location in the strap at or adjacent each portion of reduced width.

11. The hair accessory holder of claim 10, comprising a single intermediate portion of reduced width and a single intermediate fastener.

12. A hair accessory holder comprising:

a body member having a top end, a bottom end, a left side, a right side, a front surface and a back surface;

the body member having an intermediate portion of reduced width along a length thereof between the top end and the bottom end;

at least one strap extending along at least a portion of the front surface and at least a portion of the back surface;

at least one upper fastener attaching the at least one strap to the body member adjacent the top end; and at least one intermediate fastener attaching the at least one strap to or adjacent to the intermediate portion of reduced width, wherein portions of the strap between the at least one upper fastener and the at least one intermediate fastener are not attached to the body member, and wherein the at least one strap extends along the front surface from a front side of the at least one upper fastener to a front side of the at least one intermediate fastener, to the bottom end of the body member where the strap wraps around the bottom end of the body member, and continues to extend along the back surface to a back side of the at least one intermediate fastener, and to a back side of the at least one upper fastener.

13. The hair accessory holder of claim 12 further comprising one or more additional fasteners disposed in the body member to separate the hair accessories attachable to the at least one strap above the intermediate portion from hair accessories attachable to the intermediate portion of reduced width.

14. The hair accessory holder of claim 12, further comprising a hanging mechanism disposed at the top end of the body member.

15. The hair accessory holder of claim 12, wherein the body member is fabricated of a material selected from plastic, metal, wood, rubber, and cork.

16. The hair accessory holder of claim 12, wherein the at least one strap is fabricated of an elastic material.

17. The hair accessory holder of claim 12, wherein the intermediate portion separates a top portion from a bottom portion, wherein the top portion and the bottom portion each have widths greater than the reduced width of the intermediate portion, and wherein the bottom portion width is sized to prevent a hair accessory attachable to the intermediate portion from slipping downward.

18. The hair accessory holder of claim 12, further comprising one or more additional intermediate portions of reduced width disposed along a length of the body member between the top end and the bottom end.

19. The hair accessory holder of claim 18, further comprising one or more additional intermediate fasteners attaching the at least one strap to or adjacent to the one or more additional intermediate portions of reduced width.

20. The hair accessory holder of claim 12, comprising a single upper fastener attaching the at least one strap to the body member at a single location in the strap, and a single intermediate fastener in or adjacent to each portion of reduced width attaching the at least one strap to the body member at a single location in the strap at or adjacent each portion of reduced width.

* * * * *